US011643229B2

(12) United States Patent
Cousins et al.

(10) Patent No.: US 11,643,229 B2
(45) Date of Patent: May 9, 2023

(54) PORTABLE WRAPPING MACHINE

(71) Applicants: Neil G. Cousins, Tottenham (CA); Srbislav Z. Davidovic, Oakville (CA)

(72) Inventors: Neil G. Cousins, Tottenham (CA); Srbislav Z. Davidovic, Oakville (CA)

(73) Assignee: COUSINS PACKAGING INC., Mississauga (CA)

( * ) Notice: Subject to any disclaimer, the term of this patent is extended or adjusted under 35 U.S.C. 154(b) by 518 days.

(21) Appl. No.: 16/569,170

(22) Filed: Sep. 12, 2019

(65) Prior Publication Data

US 2021/0078740 A1 Mar. 18, 2021

(51) Int. Cl.
*B65B 11/02* (2006.01)
*B65B 11/00* (2006.01)

(52) U.S. Cl.
CPC ..... *B65B 11/025* (2013.01); *B65B 2011/002* (2013.01)

(58) Field of Classification Search
CPC ..... B65B 11/025; B65B 2011/002
USPC ..... 53/399, 441, 588
See application file for complete search history.

(56) References Cited

U.S. PATENT DOCUMENTS 3,675,388 A * 7/1972 Lems ..... B65B 43/30 53/392
4,095,395 A * 6/1978 Goldstein ..... B65B 11/025 53/210
4,209,961 A * 7/1980 Donnelley ..... B65B 11/025 409/126
4,282,700 A * 8/1981 Goldstein ..... B65B 11/025 53/556
4,369,614 A 1/1983 Tetzner
4,616,474 A 10/1986 Morley et al.
4,631,898 A * 12/1986 Brambilla ..... B65B 11/025 53/399
4,722,170 A * 2/1988 Ball ..... B65B 11/025 53/556

(Continued)

FOREIGN PATENT DOCUMENTS

AU 3570178 A 11/1979
FR 2727075 A1 5/1996

OTHER PUBLICATIONS

European Search Report issued in corresponding European Application No. 19207054.8 dated Jun. 9, 2020 (6 pages).

(Continued)

*Primary Examiner* — Robert F Long
*Assistant Examiner* — Xavier A Madison
(74) *Attorney, Agent, or Firm* — Flynn Thiel, P.C.

(57) ABSTRACT

A wrap machine assembly including a pallet having a top surface having goods thereon and a side surface. The top surface is located above a floor. The wrap machine assembly also includes a wrapping machine having a base and a wrapping arm including a roll of wrap film. The base of the wrapping machine has at least one front wheel and at least one rear wheel. A portion of the wrapping machine is positioned adjacent the side surface of the pallet. The wrapping arm encircles the goods on the pallet, with a circle of rotation of the wrapping arm forming a periphery of a wrap circle area. The at least front wheel of the base of the wrapping machine is located within the wrap circle area when the pallet is viewed from above. No part of the wrapping machine is located under the pallet.

38 Claims, 10 Drawing Sheets

(56) References Cited

U.S. PATENT DOCUMENTS

| | | | | |
|---|---|---|---|---|
| 4,905,448 | A * | 3/1990 | Plitt | B65B 11/025 53/399 |
| 5,423,163 | A * | 6/1995 | Wendt | B65B 11/025 53/556 |
| 6,170,228 | B1 | 1/2001 | Zeman, III | |
| 6,237,307 | B1 * | 5/2001 | Zentmyer | B65B 67/085 53/390 |
| 6,449,928 | B1 | 9/2002 | Huson | |
| 6,470,657 | B2 | 10/2002 | Huson et al. | |
| 6,526,734 | B1 | 3/2003 | Huson et al. | |
| 6,742,322 | B2 | 6/2004 | Qicang | |
| 7,040,071 | B2 * | 5/2006 | Heikaus | B65B 11/025 53/210 |
| 7,051,492 | B2 | 5/2006 | Huson | |
| 7,621,107 | B2 | 11/2009 | Vanderheiden et al. | |
| 10,689,138 | B2 * | 6/2020 | Laghi | B65B 11/025 |
| 2002/0162436 | A1 | 11/2002 | Marois et al. | |
| 2005/0044812 | A1 | 3/2005 | Lancaster, III et al. | |
| 2007/0209324 | A1 | 9/2007 | Lancaster, III et al. | |
| 2009/0293425 | A1 | 12/2009 | Carter et al. | |
| 2012/0042615 | A1 * | 2/2012 | Roche | B65B 11/025 53/461 |
| 2016/0200467 | A1 * | 7/2016 | Cousins | B65B 11/025 53/556 |

OTHER PUBLICATIONS

Image of "Robopac" robotic wrapping machine known before invention (1 page).

Brochure by Heikaus; "World Premiere—RD 202—the mobile, non-system connected stretch machine!" known before invention (2 pages).

Brochure; "P 400—la banderoleuse mobile qui garantit maniabilité et haut rendement." known before invention (1 page).

Robopac's Robot Master—brochure dated Mar. 2014 retrieved on May 25, 2018 from URL http://www.robopac.com/media/files/079_2127_Robopac_CatMaster_ItEn_lr_ok.pdf (12 pages).

Robopac's Robot Master—specifications and technical features available online—retrieved on May 25, 2018 from URL http://www.robopac.com/en-IT/products/Vertical_stretch_wrapping_machines/Self_propelled_Robots/robot_master_plus (10 pages).

* cited by examiner

PORTABLE WRAPPING MACHINE

FIELD OF THE INVENTION

The present invention concerns wrapping machines, and more particularly relates to a portable wrapping machine.

BACKGROUND OF THE INVENTION

During the past several decades, considerable developments have been made in the field of wrapping a load with a web of film. Most wrapping machines are stationary.

SUMMARY OF THE INVENTION

The present invention, according to one aspect, is directed to a method of wrapping goods comprising providing goods on a pallet, with the pallet having a top surface having the goods thereon and at least one side surface, the top surface being located above a floor. The method further comprises providing a wrapping machine with a base and a wrapping arm having a roll of wrap film, providing the base of the wrapping machine with at least one front wheel and at least one rear wheel, positioning a portion of the wrapping machine adjacent the at least one side surface of the pallet, and encircling the goods on the pallet with the wrapping arm to wrap the wrap film around the goods. A circle of rotation of the wrapping arm forms a periphery of a wrap circle area. The at least one front wheel of the base of the wrapping machine is located within the wrap circle area when the pallet is viewed from above. No part of the wrapping machine is located under the pallet during the step of encircling the goods on the pallet.

Yet another aspect of the present invention is to provide a wrap machine assembly comprising a pallet having goods thereon, with the pallet having a top surface having the goods thereon and at least one side surface. The top surface is located above a floor. The wrap machine assembly further includes a wrapping machine having a base and a wrapping arm including a roll of wrap film, with the base of the wrapping machine having at least one front wheel and at least one rear wheel. A portion of the wrapping machine is positioned adjacent the at least one side surface of the pallet. The wrapping arm encircles the goods on the pallet, with a circle of rotation of the wrapping arm forming a periphery of a wrap circle area. The at least front wheel of the base of the wrapping machine being located within the wrap circle area when the pallet is viewed from above. No part of the wrapping machine is located under the pallet.

Yet another aspect of the present invention is to provide a method of wrapping goods comprising providing goods on a pallet, with the pallet having a top surface having the goods thereon and at least one side surface. The top surface is located above a floor. The method further comprises providing a wrapping machine with a base and a wrapping arm having a roll of wrap film, providing the base of the wrapping machine with at least one front wheel and at least one rear wheel, abutting the portion of the wrapping machine against the at least one side surface of the pallet, and encircling the goods on the pallet with the wrapping arm to wrap the wrap film around the goods. No part of the wrapping machine is located under the pallet during the step of encircling the goods on the pallet.

DETAILED DESCRIPTION OF THE PREFERRED EMBODIMENT

Figure 1:
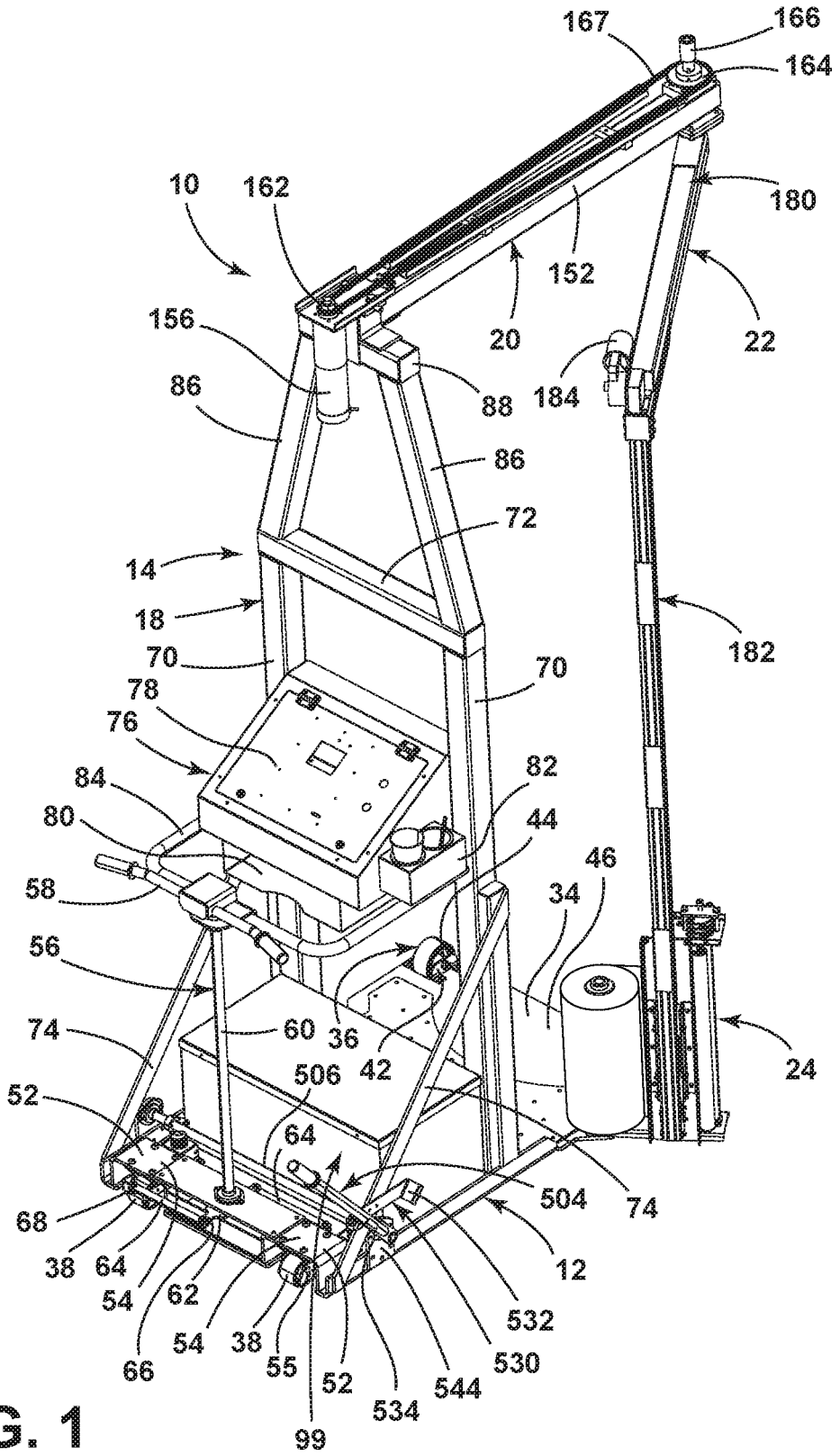
FIG. 1 is a first rear perspective view of a portable wrapping machine of the present invention.
Figure 2:
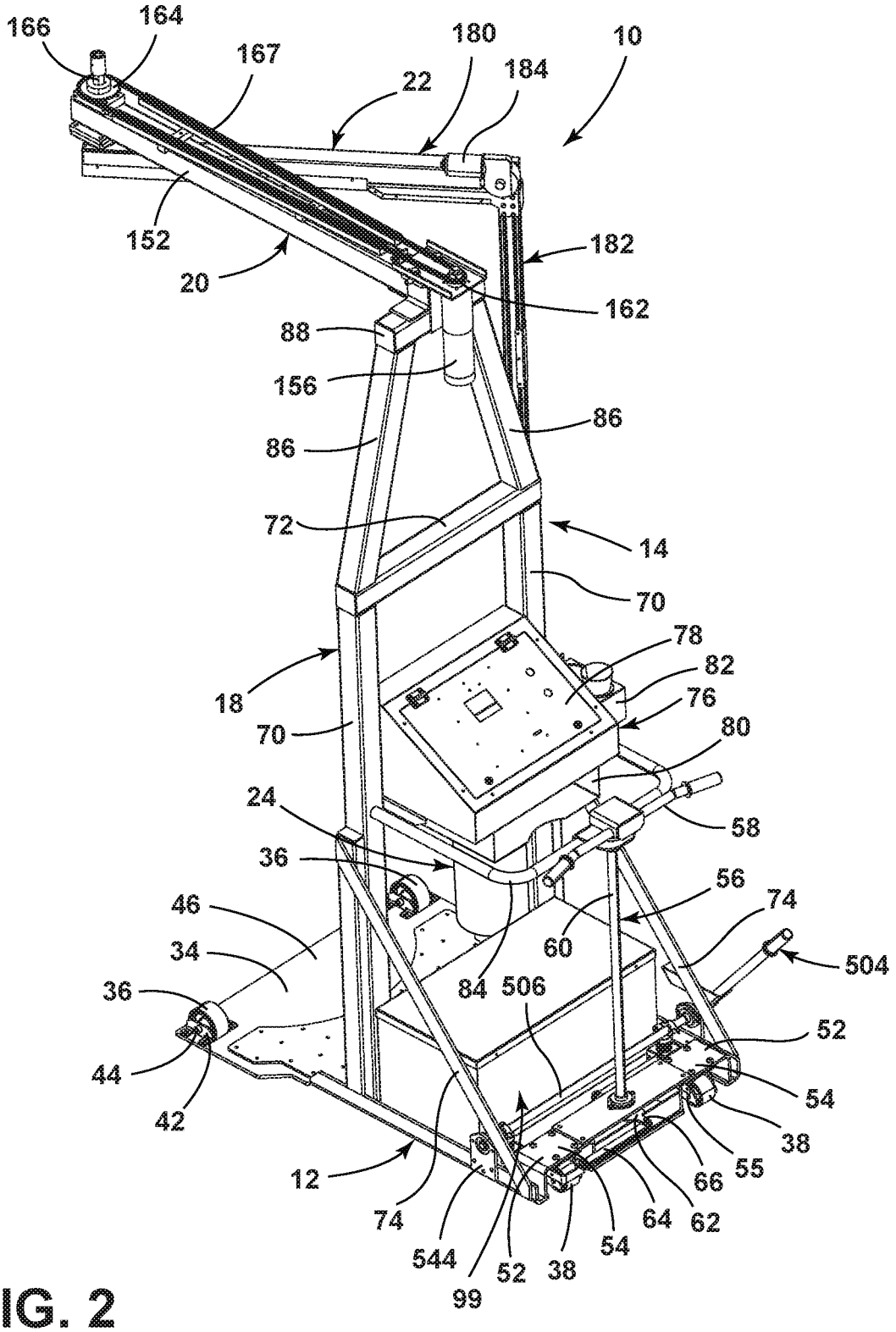
FIG. 2 is a second rear perspective view of the portable wrapping machine of the present invention.
Figure 3:
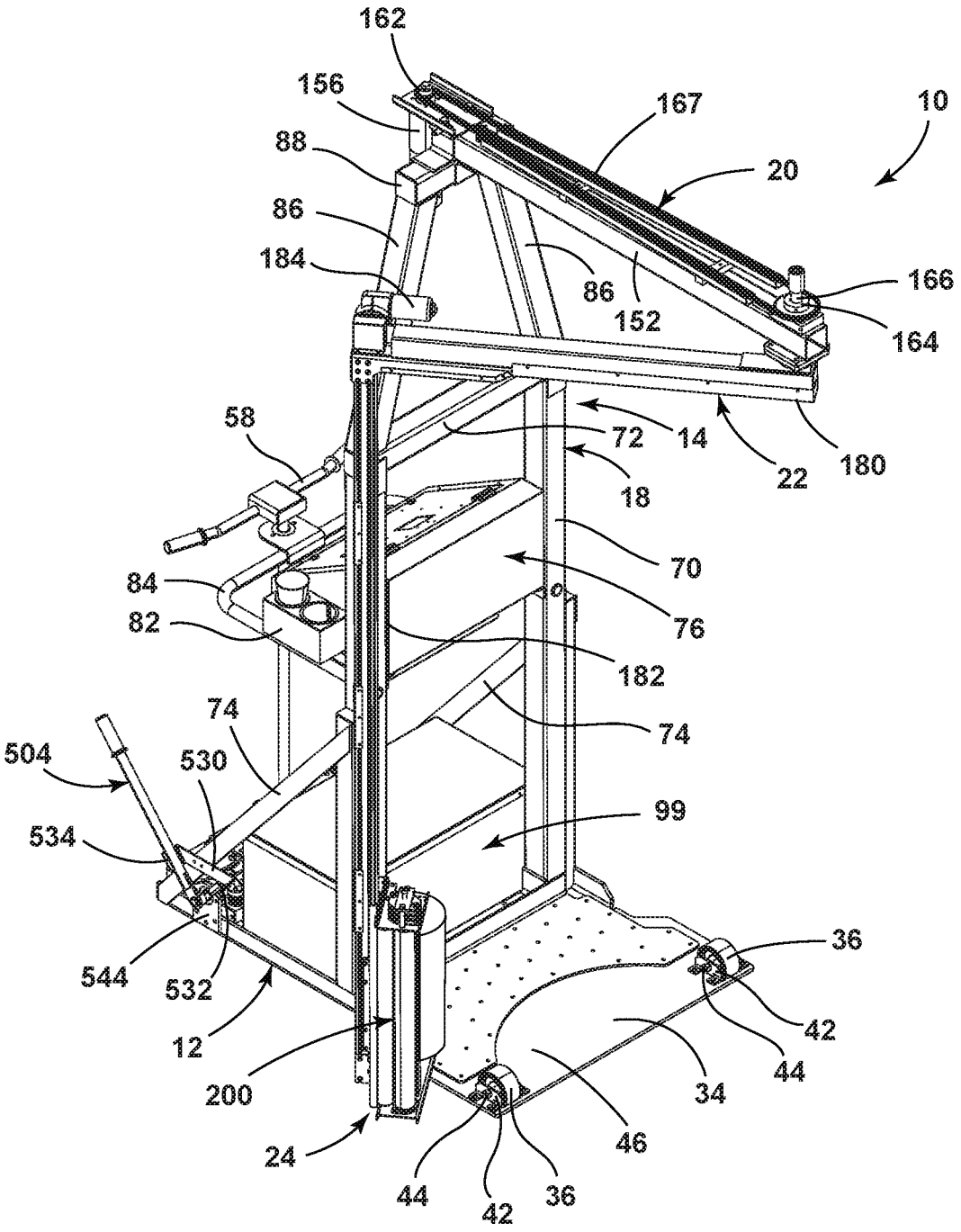
FIG. 3 is a first front perspective view of the portable wrapping machine of the present invention.
Figure 4:
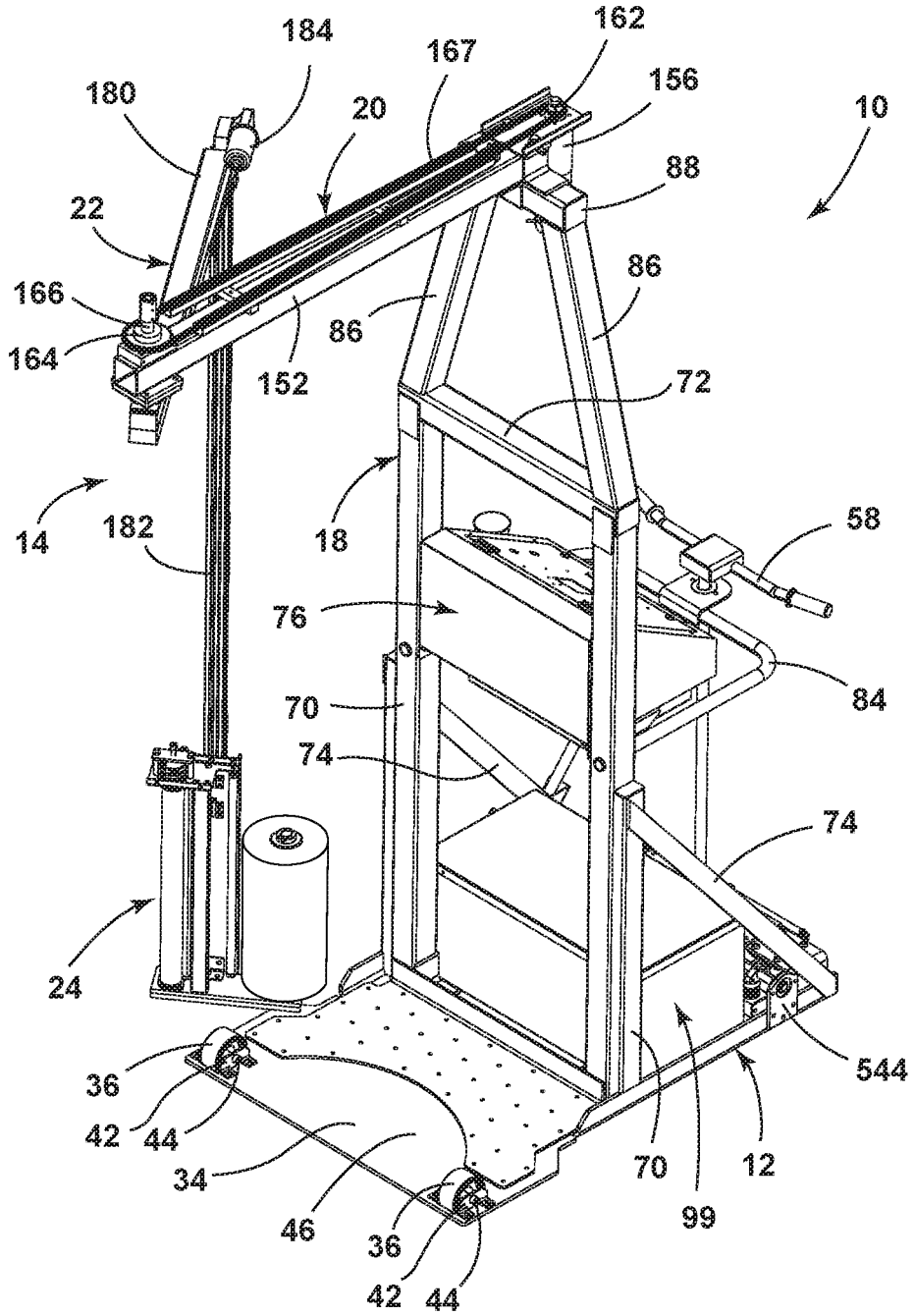
FIG. 4 is a second front perspective view of the portable wrapping machine of the present invention.
Figure 5:
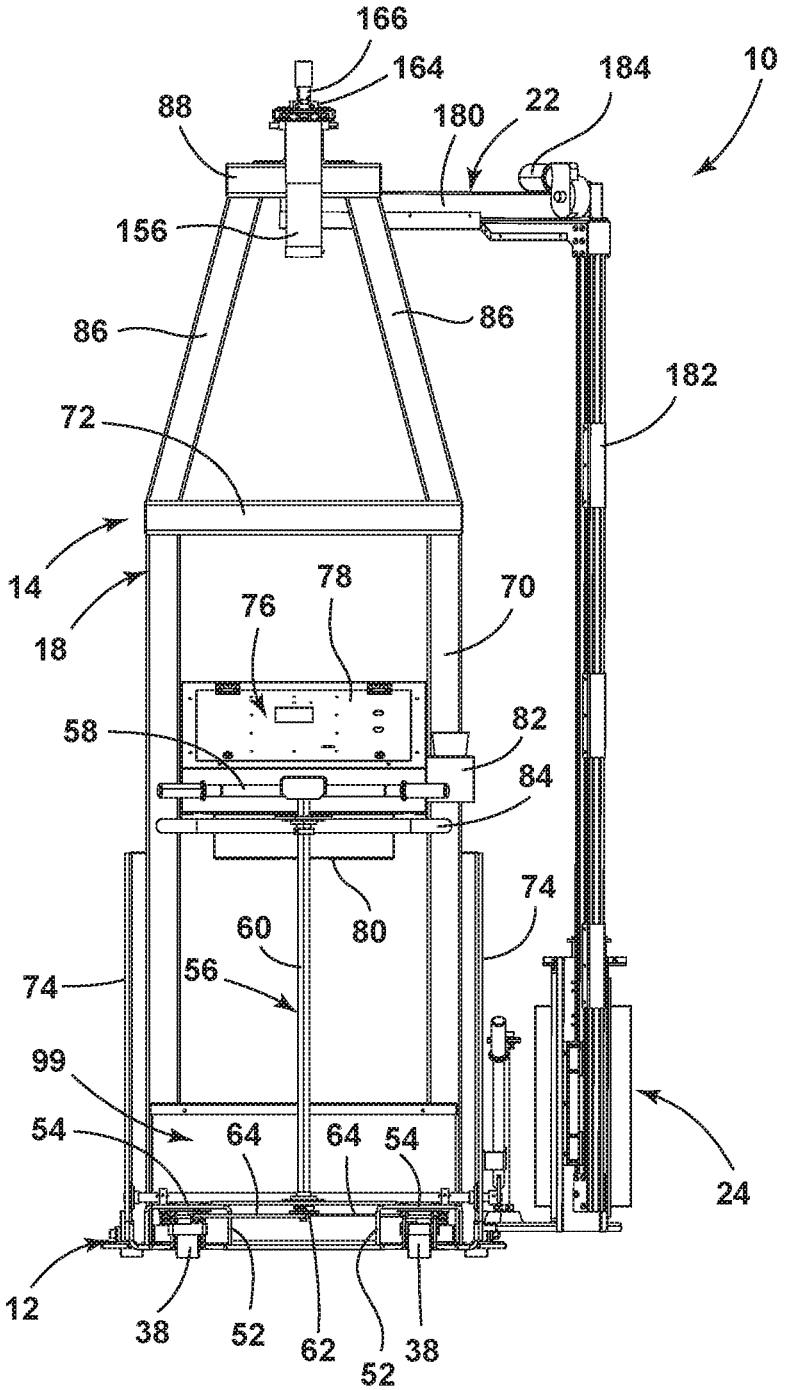
FIG. 5 is a rear view of the portable wrapping machine of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts. Hence, specific dimensions and other physical characteristics relating to the embodiments disclosed herein are not to be considered as limiting.

The reference number 10 (FIGS. 1-8) generally designates a portable wrapping machine of the present invention. The portable wrapping machine 10 is configured to be moved adjacent to a pallet 32 having goods 28 on a top surface thereof to wrap the goods 28 with wrap film 11. The goods 28 can be a single product (open or boxed) or a plurality of products (open or boxed). The portable wrapping machine 10 is portable to allow the portable wrapping machine 10 to be moved to the pallet 32 with the goods thereon instead of moving the pallet 32 to a stationary wrapping machine. The portable wrapping machine 10 is configured to be movable such that the portable wrapping machine 10 can be moved to the goods 28 and wrap the goods 28 from a top 16 thereof to the floor 30 to thereby allow the pallet 32 under the goods 28 to be wrapped.

In the illustrated example, the portable wrapping machine 10 includes a movable base 12 having a wrapping column 14 mounted thereon. The wrapping column 14 includes a post assembly 18, a cantilevered arm 20 extending from a top of the post assembly 18 and an inverted L-shaped wrapping arm 22 depending downwardly from the cantilevered arm 20. A carriage 24 rides on the inverted L-shaped wrapping arm 22. The wrap film 11 is pulled from a roll 26 of wrap film 11 on the carriage 24 to wrap the goods 28 (see FIGS. 7-8) while the inverted L-shaped wrapping arm 22 rotates about the goods 28.

In the illustrated example, the movable base 12 allows the portable wrapping machine 10 to be moved to the goods 28 to wrap the goods 28 with the wrap film 11. The movable base 12 includes a support plate 34 having at least one front wheel 36 and at least one rear wheel 38 connected thereto, with the at least one front wheel 36 and the at least one rear wheel 38 allowing the movable base 12 and thereby the portable wrapping machine 10 to be moved. In the illustrated example, the movable base 12 has a pair of front wheels 36 and a pair of rear wheels 38. However, it is contemplated that only one rear wheel 38 or only one front wheel 36 could be used or multiple wheels could be used. The support plate 34 is formed of any material that can provide stability to and support every element on the support plate 34. For example, the support plate 34 can be formed of metal (e.g., solid steel of ⅜-inch or ½-inch thickness) or any other stable material.

The illustrated front wheels 36 extend through openings 40 at the front of the support plate 34. A pair of L-shaped axle supports 42 connected to a top of the support plate 34 straddle each front wheel 36 and a front wheel axle 44 extends though the adjacent front wheel 36 and into the pair of L-shaped axle supports 42 to allow the front wheel 36 to rotate. The front wheel axle 44 is located above a top surface 46 of the support plate 34 to allow the support plate 34 to have a low profile and be located close to the floor 30. As shown, the front wheel axles 44 are fixed in position relative to the support plate 34 such that the front wheels 36 are not allowed to turn to be able to turn the portable wrapping machine 10. However, it is contemplated that the front wheels 36 could be configured to turn. Furthermore, the front wheels 36 are configured as passive wheels such that the front wheels 36 do not have their own propulsion system. However, it is contemplated that the front wheels 36 could be powered casters to help move the portable wrapping machine 10.

Figure 6:
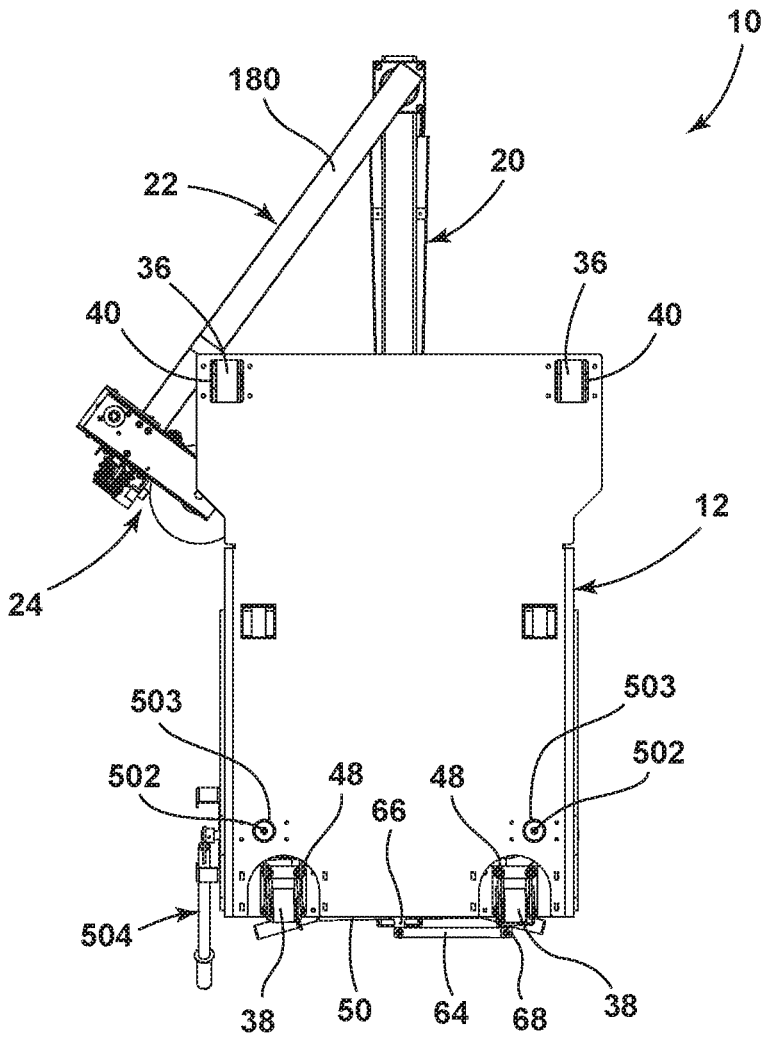
FIG. 6 is a bottom view of the portable wrapping machine of the present invention.

In the illustrated example, the rear wheels 38 are rotatable to allow the movable base 12 to be turned. As shown in FIG. 6, the support plate 34 can have recesses 48 at a rear edge 50 thereof to allow the rear wheels 38 to rotate. While the rear wheels 38 are shown as being located within recesses 48 that extend to the rear edge 50, it is contemplated that the recesses 48 could be located entirely within the periphery of the support plate 34. An inverted U-shaped support 52 is located above each recess 48 and the rear wheels 38 are casters connected to a top portion 54 of the inverted U-shaped support 52. The illustrated rear wheels 38 are free to rotate about a vertical axis connected to the inverted U-shaped support 52 and a horizontal axis of an axle 55 of the caster. While a pair of rear wheels 38 are shown, it is contemplated that a single rear wheel 38 could be used. However, the single rear wheel 38 should be used with a pair of front wheels 36. Furthermore, the rear wheels 38 are configured as passive wheels such that the rear wheels 38 do not have their own propulsion system. However, it is contemplated that the front wheels 36 could be powered casters to help move the portable wrapping machine 10.

The illustrated portable wrapping machine 10 includes a steering assembly 56 that is used to push and pull the portable wrapping machine 10 as well as turn the rear wheels 38. The steering assembly 56 includes a steering handle 58, a connecting post 60, a bottom transfer plate 62 and a pair of levers 64. The steering assembly 56 is employed to turn the rear wheels 38 by turning the steering handle 58, with the rotational motion of the steering handle 58 in turn rotating the connecting post 60 and the bottom transfer plate 62. The illustrated steering handle 58, the connecting post 60 and the bottom transfer plate 62 form a solid connection and turn as an integral part. The bottom transfer plate 62 includes a pair of oppositely extending arms 66, with each of the arms 66 being connected to one of the levers 64. As the steering handle 58 and thereby the bottom transfer plate 62 rotate, the levers 64 move along a line to push and pull a wheel arm 68 connected to each of the rear wheels 38. As the bottom transfer plate 62 rotates, the levers 64 push the rear wheels 38 in the same direction, thereby turning the rear wheels 38 and allowing the portable wrapping machine 10 to turn. While a particular system for steering the portable wrapping machine 10 is shown in the drawings, it is contemplated that any system could be employed to turn the rear wheels 38 (and/or the front wheels 36) of the portable wrapping machine 10, including a steer by wire system.

In the illustrated example, the movable base 12 is used to bring the wrapping column 14 to the goods 28 for wrapping the goods 28 (and the pallet 32 if desired). The post assembly 18 of the wrapping column 14 is connected to a top of the support plate 34 adjacent a middle portion thereof and in front of the steering assembly 56. The post assembly 18 includes a pair of spaced parallel vertically extending posts 70. The posts 70 can have braces (not shown) extending between inside surfaces thereof to provide for extra stability for the post assembly 18. A pair of angled side struts 74 can extend from outside surfaces of the posts 70 to a rear portion of the movable base 12 for extra stability. A middle cross-member 72 extends between tops of the posts 70. In the illustrated example, a control panel box 76 can also extend between the posts 70 for further support. The control panel box 76 includes a control panel 78 having buttons and/or switches for controlling the wrapping of the portable wrapping machine 10 and can include a shelf 80 extending from a bottom thereof and a cup holder 82 connected to a side thereof. A U-shaped arm 84 extends rearwardly from the posts 70 and supports a top portion of the connecting post 60 of the steering assembly 56. A top of the post assembly 18 includes a pair of converging pillars 86 connected to a top of the middle cross-member 72 and a top cross-member 88 connected to tops of the converting pillars 86. The cantilevered arm 20 extends from a top of the top cross-member 88.

The illustrated cantilevered arm 20 extends sidewardly from the top of the top cross-member 88 of the post assembly 18. The cantilevered arm 20 of the illustrated embodiment is beam 152 having a rectangular cross-sectional shape. An angled brace 154 (see FIG. 7) can extend between a bottom surface of the beam 152 and a side surface of the top cross-member 88 of the post assembly 18 for added stability. A first motor assembly 156 is connected to the beam 152 of the cantilevered arm 20 at a proximal end thereof and can be powered by a battery and/or a power source from the movable base 12. The first motor assembly 156 rotates the inverted L-shaped wrapping arm 22. The first motor assembly 156 rotates a first pulley wheel 162 connected to the first motor assembly 156. A second pulley wheel 164 is located on top of the beam 152 of the cantilevered arm 20 at a distal end thereof. An endless link 167 surrounds the first pulley wheel 162 and the second pulley wheel 164 such that rotation of the first pulley wheel 162 by the first motor assembly 156 causes the second pulley wheel 164 to rotate. A wrapping axle 166 is connected to the second pulley wheel 164 and rotates with the second pulley wheel 164. The inverted L-shaped wrapping arm 22 is also connected to the wrapping axle 166 and rotates with the wrapping axle 166.

In the illustrated example, the inverted L-shaped wrapping arm 22 rotates about the goods 28 to wrap the goods 28 with the wrap film 11. The inverted L-shaped wrapping arm 22 includes a horizontal portion 180 and a vertical portion 182. The carriage 24 is connected to the vertical portion 182 and is configured to move vertically along the vertical portion 182 of the inverted L-shaped wrapping arm 22. An inner end of the horizontal portion 180 of the inverted L-shaped wrapping arm 22 is connected to a bottom of the wrapping axle 166 and rotates with the wrapping axle 166. A second motor assembly 184 is located at a distal end of the horizontal portion 180 of the inverted L-shaped wrapping arm 22. The second motor assembly 184 includes a motor powered that can be powered by a battery and/or a power source from the movable base 12. The second motor assembly 184 includes a spool that is rotated by the motor thereof. A cable 190 extending along the vertical portion 182 is configured to be selectively pulled and wrapped onto the spool or unwound from the spool to raise and lower the carriage 24. Although a particular location of the first motor assembly 156 and the second motor assembly 184 as shown in the drawings for rotating the inverted L-shaped wrapping arm 22 and raising and lowering the carriage 24, it is contemplated that any system of motors, wheels and/or pulleys could be employed to rotate the inverted L-shaped wrapping arm 22 along with raising and lowering the carriage 24.

The illustrated carriage 24 includes the roll 26 of the wrap film 11 used to wrap the goods 28. In the illustrated example, the wrap is pre-stretched before being wrapped about the goods 28 using pre-stretch rollers 200 on the carriage. However, it is contemplated that the carriage 24 could pre-stretch the wrap in order to lengthen the wrap in a manner known to those skilled in the art. In the illustrated embodiment, several portions of the portable wrapping machine 10 are shown as not including a cover. For example, the horizontal portion 152, the pulley wheels 162 and 164, the endless link 167, and a portion of a movable stabilizer 500*a* detailed below are shown as being exposed. However, all of those portions of the portable wrapping machine 10 can be covered by covers.

Figure 7:
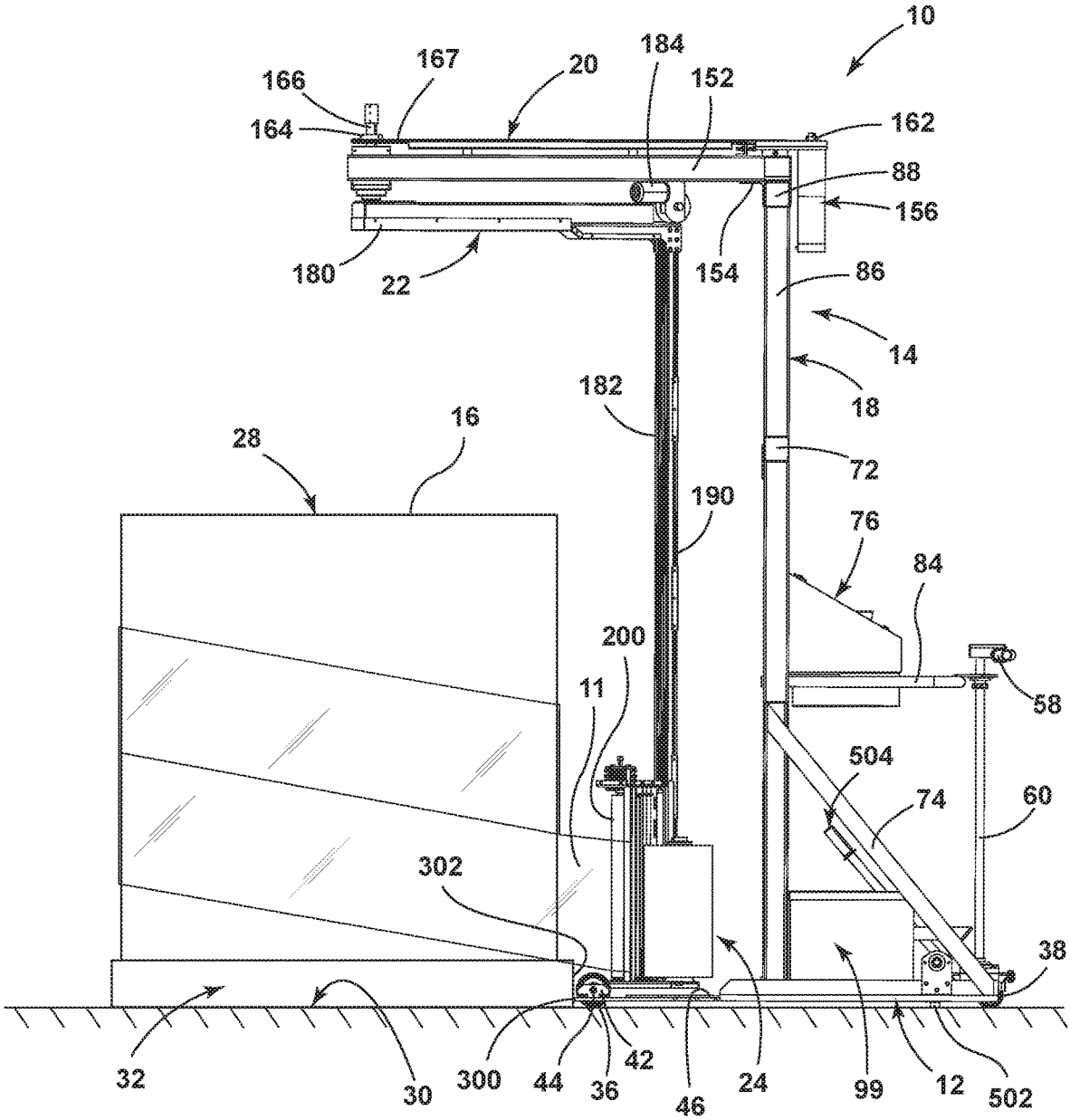
FIG. 7 is a side view of the portable wrapping machine of the present invention illustrating wrapping of goods on a pallet.
Figure 8:
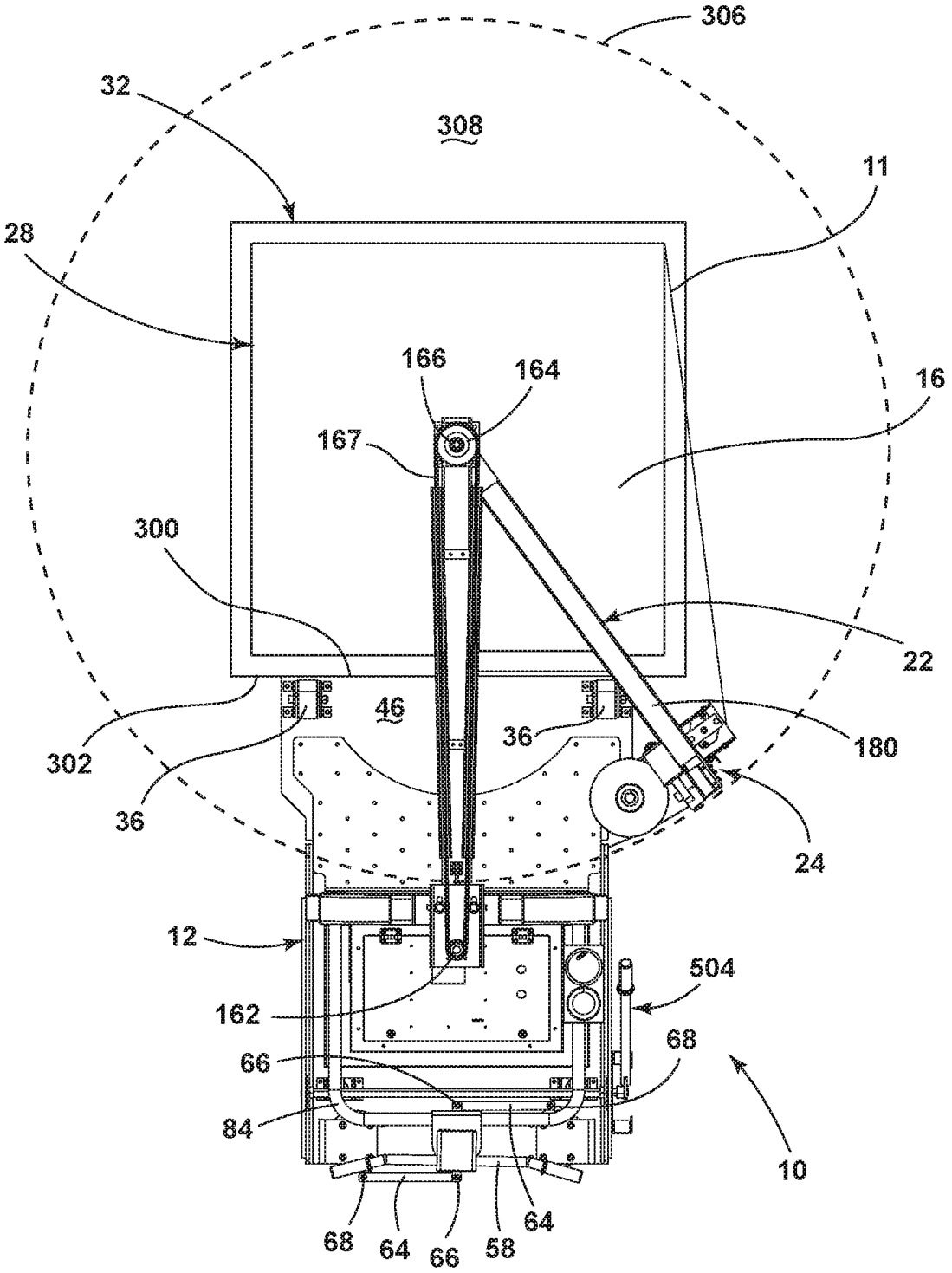
FIG. 8 is a top view of the portable wrapping machine of the present invention illustrating wrapping of goods on the pallet.

FIGS. 7 and 8 illustrate an embodiment of wrapping the goods 28 with the wrap film 11 using the portable wrapping machine 10. First, the portable wrapping machine 10 is moved to the pallet 32 until a front portion 300 of the base 12 (or an extension from the movable base 12) abuts a side surface 302 of the pallet 32. As shown, no portion of the portable wrapping machine 10 is located under the pallet 32 during this procedure such that the pallet 32 does not need any openings in the side surface 302 thereof for accepting a portion of the portable wrapping machine 10. At that point, the portable wrapping machine 10 is stabilized. For example, any or all of the wheels of the portable wrapping machine 10 can be locked in position and/or a movable stabilizer (with examples thereof discussed in more detail below) can be deployed.

Second, a free end of the wrap film 11 extending from the carriage 24 is positioned on the goods 28 or otherwise held on the goods 28. Third, the inverted L-shaped wrapping arm 22 is activated to rotate about the goods 28 with the carriage 24 moving up and down along the vertical portion 182 of the inverted L-shaped wrapping arm 22 by being pulled upward by the cable 190 (via the second motor assembly 184) and by being allowed to lower through the force of gravity to a selected position by the cable 190 (via the second motor assembly 184). The carriage 24 is allowed to move to a position slightly above the floor 30 to be able to position the wrap film 11 about the bottom of the goods 28 and the side surface 302 of the pallet 32, if desired. The carriage 24 and the inverted L-shaped wrapping arm 22 never need to touch the floor 30 to be able to wrap the bottom of the goods 28 and a top area of the sides of the pallet 32.

As shown in FIG. 8, a circle of rotation 306 of the inverted L-shaped wrapping arm 22 forms a periphery of a wrap circle area 308. At least one front wheel 36 of the movable base 12 of the portable wrapping machine 10 can be located within the wrap circle area 308 when the pallet 32 is viewed from above such as that shown in FIG. 8. During the step of encircling the goods 28 on the pallet 32 with the inverted L-shaped wrapping arm 22 to wrap the wrap film 11 around the goods 28, the wrap film 11 can abut and slide over the front wheels 36 (or a cover for the front wheels 36 that extends upward from the top surface 46 of the movable base 12) as the wrap film 11 passes over the front wheels 36. It is contemplated that the base 12 can include a storage compartment 99 for storing a battery or batteries (rechargeable or not) for powering the wheels 36 and 38, the first motor assembly 156, and/or the second motor assembly 184. It is further contemplated that the first motor assembly 156 and/or the second motor assembly 184 could be powered by a power cord connected to the portable wrapping machine 10 and plugged into a typical power outlet. Other power systems are also contemplated (e.g., induction power). Finally, it is contemplated that the portable wrapping machine 10 could selectively be powered by a battery or directly from an outlet.

Figure 9:
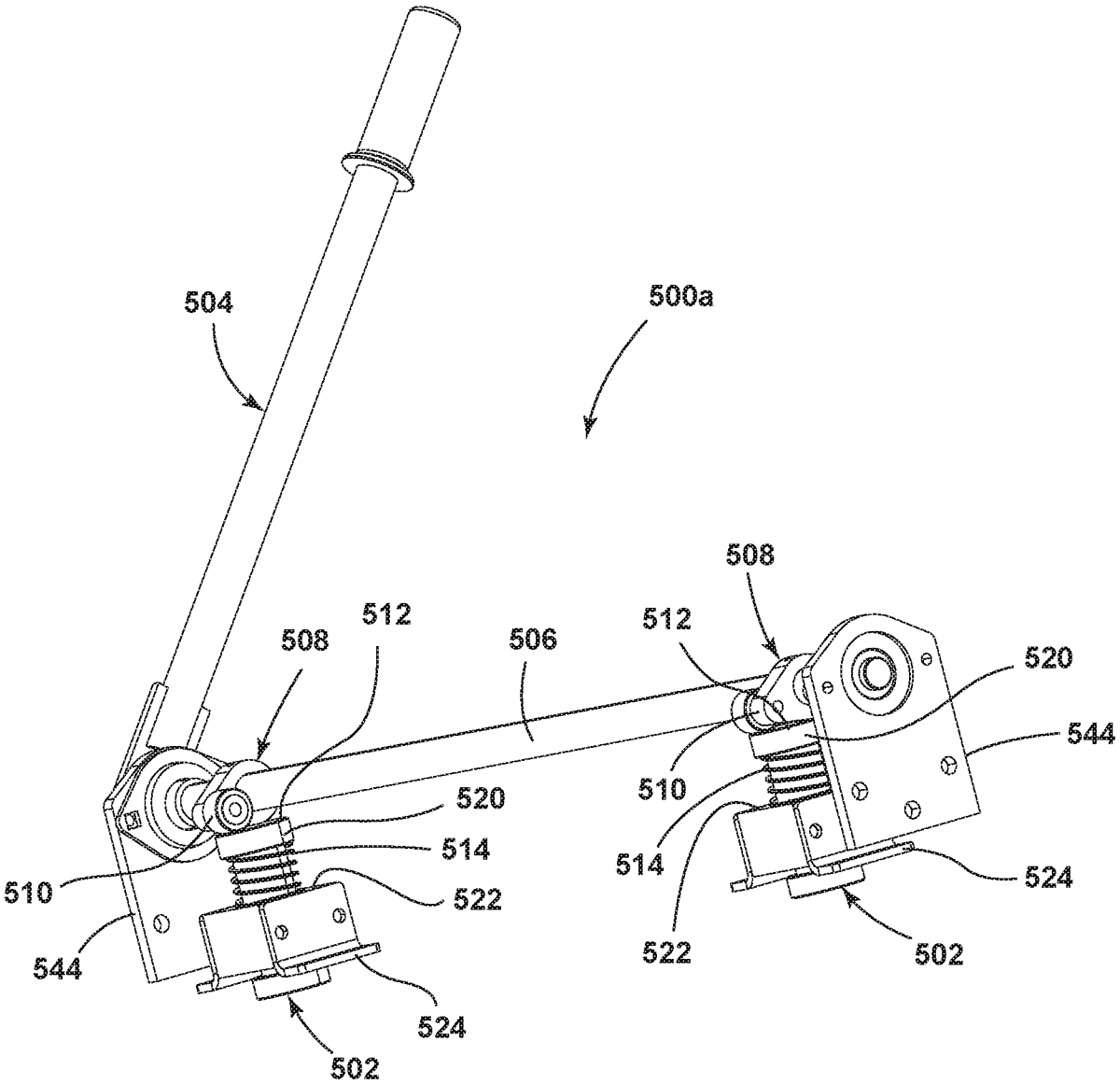
FIG. 9 is a perspective view of a first embodiment of a movable stabilizer of the portable wrapping machine of the present invention.

FIG. 9 illustrates an example of a movable stabilizer 500*a* for maintaining the portable wrapping machine 10 in a set location. The movable stabilizer 500*a* includes a pair of linearly movable feet 502 configured to selectively be lowered to abut the floor 30 to assist in maintaining the portable wrapping machine 10 adjacent the pallet 32. The movable stabilizer 500*a* includes a lever 504 that rotates a rod 506 having a pair of eccentric actuators 508 that abut against a top 512 of the feet 502. As the lever 504 is moved to rotate the rod 506, the eccentric actuators 508 have ears 510 that push and roll on the top 512 of the feet 502 to move the feet downward against the bias of springs 514 that are compressed between a rim 520 of the top 512 of the feet 502 and a top surface 522 of a holder 524 for the feet 502.

As illustrated in FIG. 1, the portable wrapping machine 10 includes a C-shaped movement limiting bar 530 that limits movement of the lever 504. As shown in FIGS. 7 and 8, when the lever 504 abuts against a deployment side 532 of the C-shaped movement limiting bar 530, the feet 502 stay deployed to stabilize the portable wrapping machine 10 because the ears 510 press the top 512 of the feet 502 downward. As shown in FIG. 6, the feet 502 extend through apertures 503 in the movable base 12 when in the deployed position. When the lever 504 is rotated in the opposite direction to abut against the stored side 534 of the C-shaped movement limiting bar 530, the ears 510 no longer press against the top 512 of the feet 502 to allow the feet 502 to move to the stored position. The movable stabilizer 500*a* includes a pair of support flanges 544 connected to the base 12 of the portable wrapping machine 10 holding opposite ends of the rod 506 to allow the rod 506 to rotate above an axis fixed in position relative to the movable base 12 of the portable wrapping machine 10. The holders 524 for the feet 502 are also connected to the movable base 12 of the portable wrapping machine 10.

Figure 10:
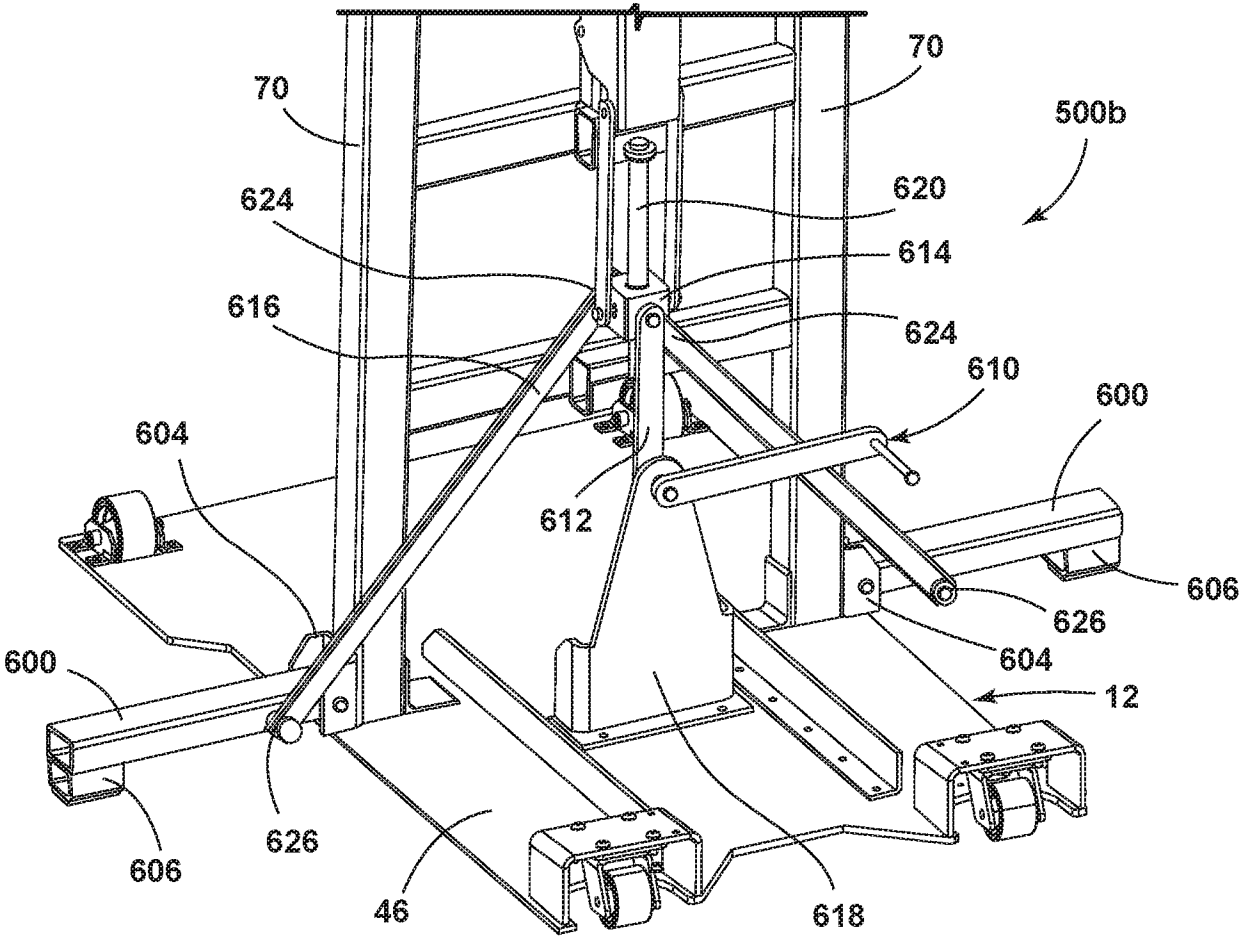
FIG. 10 is a perspective view of a second embodiment of a movable stabilizer of the portable wrapping machine of the present invention.

FIG. 10 illustrates another example of a movable stabilizer 500*b* for maintaining the portable wrapping machine 10 in a set location. The movable stabilizer 500*b* includes a pair of legs 600 that are deployed outside a periphery of the movable base 12 of the portable wrapping machine 10. The movable stabilizer 500*b* comprises the legs 600 and a leg actuator 602. The legs 600 are pivoted to the movable base 12 at pivot flanges 604 located outside of the posts 70. The legs 600 pivot about the pivot flanges 604 and each include a pad 606 that contacts the floor 30 when the movable stabilizer 500*b* is actuated (as shown in FIG. 10). The leg actuator 602 includes a rotatable handle 610, a linearly movable link 612, a connection block 614 and a pair of actuating rods 616. As the rotatable handle 610 is rotated in a support 618 connected to the top surface 46 of the movable base 12, the linearly movable link 612 is raised and lowered. The rotatable handle 610 is connected to the linearly movable link 612 in any manner that can transfer rotation movement to linear movement (e.g., a rack and pinion system). As the linearly movable link 612 moves up and down, the connection block 614 connected to the linearly movable link 612 also moves up and down on a vertical support pin 620 extending through a vertical hole in the connection block 614. The connection block 614 is also rotatably connected to a first end 624 of the actuating rods 616. As the first end 624 of the actuating rods 616 move upward with the connection block 614, a second end 626 of the actuating rods 616 connected to the legs 600 force the legs 600 to pivot about the pivot flanges 604 to a stored position. Likewise, when the rotatable handle 610 is rotated in an opposite direction, the link 612 and thereby the connection block 614 move downward, thereby moving the actuating rods 616 downward to force the legs 600 about the pivot flanges 604 to move the legs 600 downward to a deployed position which lifts the rear wheels 38 off of the floor 30 (or at least prevents them from rolling).

In the illustrated example, the goods 28 and, if desired, a top portion of the side surface 302 of the pallet 32 can be easily wrapped with wrap film 11 using the portable wrapping machine 10. The base 12 can be positioned to abut the pallet 32 for easily locating the portable wrapping machine 10 in a proper position relative to the pallet 32. It is noted that the base 12 abutting the pallet 32 can include the support plate 34 or any element extending from the support plate 34 and fixed in position relative thereto. As the goods 28 are wrapped, the tension from the wrap film 11 being pulled from the roll 26 and about the goods 28 and/or pallet 32 can pull the base 12 toward the pallet 32 to stabilize the portable wrapping machine 10. It is contemplated that the base 12 could be spaced from the pallet 32 during use and wrapping of the goods 28 as long as the base 12 is held in a stationary position. In such a situation, the front wheel 36 would continue to be located within the wrap circle area 308 and no part of the wrapping machine 10 would be located under the pallet 32.

The above description is considered that of the one embodiment only. Modification of the invention will occur to those skilled in the art and to those who make or use the invention. Therefore, it is understood that the embodiment shown in the drawings and described above is merely for illustrative purposes and not intended to limit the scope of the invention.

What is claimed is:

1. A method of wrapping goods comprising:

providing goods on a pallet, the pallet having a top surface having the goods thereon and at least one side surface, the top surface being located above a floor;

providing a wrapping machine with a base and a wrapping arm having a roll of wrap film;

providing the base of the wrapping machine with at least one front wheel and at least one rear wheel;

positioning a portion of the wrapping machine adjacent the at least one side surface of the pallet; and encircling the goods on the pallet with the wrapping arm to wrap the wrap film around the goods, a circle of rotation of the wrapping arm forming a periphery of a wrap circle area, the at least one front wheel of the base of the wrapping machine being located within the wrap circle area when the pallet is viewed from above;

wherein no part of the wrapping machine is located under the pallet during the step of encircling the goods on the pallet; and wherein the base remains stationary relative to the pallet during the step of encircling.

2. The method of claim 1, further including:

abutting the portion of the wrapping machine against the at least one side surface of the pallet.

3. The method of claim 1, further including:

surrounding a top area of the sides of the pallet with the wrap film.

4. The method of claim 1, wherein:

positioning the portion of the wrapping machine adjacent the at least one side surface of the pallet includes abutting the base of the wrapping machine against the at least one side surface of the pallet.

5. The method of claim 1, wherein:

the wrapping arm does not contact the floor during the step of encircling the goods on the pallet.

6. The method of claim 1, further including:

providing the base with a movable stabilizer; and lowering a portion of the movable stabilizer such that the portion of the movable stabilizer abuts the floor to assist in maintaining the wrapping machine adjacent the pallet.

7. The method of claim 6, wherein:

the portion of the movable stabilizer abuts the floor at a location under the base.

8. The method of claim 7, further including:

providing the base with a lowering lever;

moving the lowering lever to move the at least one linearly movable foot against a bias of a spring.

9. The method of claim 6, wherein:

the portion of the movable stabilizer comprises at least one linearly movable foot.

10. The method of claim 6, wherein:

the portion of the movable stabilizer abuts the floor at a location outside a periphery of the base.

11. The method of claim 1, wherein:

during the step of encircling the goods on the pallet with the wrapping arm to wrap the wrap film around the goods, the wrap film abuts the at least one front wheel or a cover for the at least one front wheel that extends upward from a top surface of the base of the wrapping machine as the wrap film passes over the at least one front wheel.

12. The method of claim 1, further including:

providing the wrapping machine with a carriage carrying the roll of wrap film; and raising and lowering the carriage to wrap the goods.

13. The method of claim 12, further including:

pre-stretching the wrap film within the carriage.

14. The method of claim 1, wherein:

the at least one front wheel comprises two front wheels; and the at least one rear wheel comprises two rear wheels.

15. The method of claim 1, further including:

providing the wrapping machine with a steering assembly for rotating the at least one rear wheel about an axis perpendicular to the axis of rotation of the wrapping arm.

16. The method of claim 1, further including:

powering rotation of the wrapping arm with a motor.

17. A method of wrapping goods comprising:
providing goods on a pallet, the pallet having a top surface having the goods thereon and at least one side surface, the top surface being located above a floor;
providing a wrapping machine with a base and a wrapping arm having a roll of wrap film;
providing the base of the wrapping machine with at least one front wheel and at least one rear wheel;
positioning a portion of the wrapping machine adjacent the at least one side surface of the pallet; and
encircling the goods on the pallet with the wrapping arm to wrap the wrap film around the goods, a circle of rotation of the wrapping arm forming a periphery of a wrap circle area, the at least one front wheel of the base of the wrapping machine being located within the wrap circle area when the pallet is viewed from above;
wherein no part of the wrapping machine is located under the pallet during the step of encircling the goods on the pallet;
further including:
providing the wrapping machine with a vertical support extending upward from the base and a horizontal support cantilevered from an upper end of the vertical support; and
rotatably connecting the wrapping arm to an end of the horizontal support opposite the vertical support.

18. The method of claim 17, wherein:
the wrapping arm includes a horizontal portion rotatably connected to the horizontal support and a vertical portion holding the roll of wrap film; and
further including moving the roll of wrap film vertically along the vertical portion of the wrapping arm.

19. A wrap machine assembly comprising:
a pallet having goods thereon, the pallet having a top surface having the goods thereon and at least one side surface, the top surface being located above a floor;
a wrapping machine having a base and a wrapping arm including a roll of wrap film, the base of the wrapping machine having at least one front wheel and at least one rear wheel;
a portion of the wrapping machine being positioned adjacent the at least one side surface of the pallet;
wherein the wrapping arm encircles the goods on the pallet, with a circle of rotation of the wrapping arm forming a periphery of a wrap circle area, the at least one front wheel of the base of the wrapping machine being located within the wrap circle area when the pallet is viewed from above; and
wherein no part of the wrapping machine is located under the pallet; and
wherein the base remains stationary relative to the pallet while the wrapping arm encircles the goods on the pallet.

20. The wrap machine assembly of claim 19, wherein:
the portion of the wrapping machine is abutted against the at least one side surface of the pallet.

21. The wrap machine assembly of claim 19, wherein:
a top area of the sides of the pallet are surrounded with the wrap film.

22. The wrap machine assembly of claim 19, wherein:
the base of the wrapping machine is abutted with the at least one side surface of the pallet.

23. The wrap machine assembly of claim 19, wherein:
the wrapping arm does not contact the floor while encircling the goods on the pallet.

24. The wrap machine assembly of claim 19, wherein:
the base includes a movable stabilizer; and
a portion of the movable stabilizer selectively abuts the floor to assist in maintaining the wrapping machine adjacent the pallet.

25. The wrap machine assembly of claim 24, wherein:
the portion of the movable stabilizer abuts the floor at a location under the base.

26. The wrap machine assembly of claim 24, wherein:
the portion of the movable stabilizer comprises at least one linearly movable foot.

27. The wrap machine assembly of claim 26, wherein:
the base includes a lowering lever; and
the lowering lever moves the at least one linearly movable foot against a bias of a spring.

28. The wrap machine assembly of claim 24, wherein:
the portion of the movable stabilizer abuts the floor at a location outside a periphery of the base.

29. The wrap machine assembly of claim 19, wherein:
the wrap film is configured to abut the at least one front wheel or a cover for the at least one front wheel that extends upward from a top surface of the base of the wrapping machine as the wrap film passes over the at least one front wheel.

30. The wrap machine assembly of claim 19, wherein:
the wrapping machine comprises a carriage for raising and lowering the roll of wrap film to wrap the goods.

31. The wrap machine assembly of claim 30, wherein:
the carriage includes pre-stretch rollers for pre-stretching the wrap film within the carriage.

32. The wrap machine assembly of claim 19, wherein:
the at least one front wheel comprises two front wheels; and
the at least one rear wheel comprises two rear wheels.

33. The wrap machine assembly of claim 19, wherein:
the wrapping machine includes a steering assembly for rotating the at least one rear wheel about an axis perpendicular to the axis of rotation of the wrapping arm.

34. The wrap machine assembly of claim 19, further including:
a motor for powering rotation of the wrapping arm.

35. A wrap machine assembly comprising:
a pallet having goods thereon, the pallet having a top surface having the goods thereon and at least one side surface, the top surface being located above a floor;
a wrapping machine having a base and a wrapping arm including a roll of wrap film, the base of the wrapping machine having at least one front wheel and at least one rear wheel;
a portion of the wrapping machine being positioned adjacent the at least one side surface of the pallet;
wherein the wrapping arm encircles the goods on the pallet, with a circle of rotation of the wrapping arm forming a periphery of a wrap circle area, the at least one front wheel of the base of the wrapping machine being located within the wrap circle area when the pallet is viewed from above;
wherein no part of the wrapping machine is located under the pallet;
wherein the wrapping machine includes a vertical support extending upward from the base and a horizontal support cantilevered from an upper end of the vertical support; and
wherein the wrapping arm is rotatably connected to an end of the horizontal support opposite the vertical support.

36. The wrap machine assembly of claim 35, wherein:

the wrapping arm includes a horizontal portion rotatably connected to the horizontal support and a vertical portion holding the wrap film; and further including moving the roll of wrap film vertically along the vertical portion of the wrapping arm.

37. A method of wrapping goods comprising:

providing goods on a pallet, the pallet having a top surface having the goods thereon and at least one side surface, the top surface being located above a floor;

providing a wrapping machine with a base and a wrapping arm having a roll of wrap film;

providing the base of the wrapping machine with at least one front wheel and at least one rear wheel;

abutting a portion of the wrapping machine against the at least one side surface of the pallet; and encircling the goods on the pallet with the wrapping arm to wrap the wrap film around the goods;

wherein no part of the wrapping machine is located under the pallet during the step of encircling the goods on the pallet.

38. The method of claim 37, further including:

a circle of rotation of the wrapping arm forming a periphery of a wrap circle area, the at least one front wheel of the base of the wrapping machine being located within the wrap circle area when the pallet is viewed from above.

* * * * *